US008245760B2

(12) United States Patent
Yim et al.

(10) Patent No.: US 8,245,760 B2
(45) Date of Patent: Aug. 21, 2012

(54) CONTINUOUS CAST SLAB AND METHOD FOR MANUFACTURING THE SAME

(75) Inventors: Chang Hee Yim, Pohang-Si (KR); Young Mok Won, Pohang-Si (KR); Joong Kil Park, Pohang-Si (KR); Sang Hum Kwon, Pohang-Si (KR)

(73) Assignee: Posco, Pohan-Si (KR)

( * ) Notice: Subject to any disclaimer, the term of this patent is extended or adjusted under 35 U.S.C. 154(b) by 12 days.

(21) Appl. No.: 12/743,533

(22) PCT Filed: Nov. 19, 2008

(86) PCT No.: PCT/KR2008/006816

§ 371 (c)(1),
(2), (4) Date: Aug. 16, 2010

(87) PCT Pub. No.: WO2009/066929

PCT Pub. Date: May 28, 2009

(65) Prior Publication Data

US 2010/0296960 A1 Nov. 25, 2010

(30) Foreign Application Priority Data

Nov. 19, 2007 (KR) ..... 10-2007-0117930
Nov. 19, 2008 (KR) ..... 10-2008-0114967

(51) Int. Cl.
*B22D 11/12* (2006.01)
*B22D 27/02* (2006.01)

(52) U.S. Cl. ..... 164/476; 164/417; 164/468

(58) Field of Classification Search ..... 164/476, 164/417, 468

See application file for complete search history.

(56) References Cited

U.S. PATENT DOCUMENTS

| | | | | |
|---|---|---|---|---|
| 4,687,047 | A * | 8/1987 | Ogibayashi et al. | 164/476 |
| 5,063,991 | A * | 11/1991 | Bobadilla et al. | 164/468 |
| 7,086,450 | B2 | 8/2006 | Hiraki et al. | |
| 2002/0017375 | A1 | 2/2002 | Pleschiutschnigg | |
| 2003/0015260 | A1 * | 1/2003 | Zeze et al. | 148/541 |
| 2003/0213578 | A1 | 11/2003 | Hiraki et al. | |

FOREIGN PATENT DOCUMENTS

EP 1 743 721 A2 1/2007

(Continued)

OTHER PUBLICATIONS

Korean Search Report for International Application No. PCT/KR2008/006816, mailing date May 26, 2009.

(Continued)

*Primary Examiner* — Kevin P Kerns
(74) *Attorney, Agent, or Firm* — Finnegan, Henderson, Farabow, Garrett & Dunner, L.L.P.

(57) ABSTRACT

Provided is a continuous cast slab and a manufacturing method for the same, wherein solidified layers of a cast slab having a non-solidified layer are compressed with each other during a continuous casting process to fundamentally prevent occurrence of defects, such as center segregation or porosity, which deteriorate quality of the cast slab, thereby decreasing defects. A continuous casting method for producing a cast slab by drawing molten steel from a mold includes preparing a compressing unit, and reducing at least one side of the drawn cast slab by using the compressing unit, wherein solute-enriched residual molten steel is caused to flow back in a direction opposite to a casting direction. Thus, it is possible to produce a cast slab wherein defects such as center segregation are greatly eliminated.

10 Claims, 5 Drawing Sheets

FOREIGN PATENT DOCUMENTS

| | | | | |
|---|---|---|---|---|
| EP | 2 295 170 | A2 | | 3/2011 |
| JP | 63-5859 | | | 1/1988 |
| JP | 06-126405 | | | 5/1994 |
| JP | 6-126405 | A | * | 5/1994 |
| JP | 11-267814 | | | 10/1999 |
| JP | 2000-334552 | | | 5/2000 |
| JP | 2004-001079 | | | 1/2004 |
| JP | 2005-103604 | | | 4/2005 |
| JP | 2007-331000 | | | 12/2007 |

OTHER PUBLICATIONS

Antoine, P. et al., "Prevention of Segregation in Continuous Casting of Steel: New Process and Industrial Development at Unimétal Neuves-Maisons Works," La Revue de Metallurgie—Cahiers d' Informations Techniques, vol. 89, No. 1, pp. 65-72 (1992).

Bobadilla, M. et al., "Continuous Casting of Steel: A Close Connection Between Solidification Studies and Industrial Process Development," Materials Science and Engineering A, vol. 173, No. 1-2, pp. 275-285 (1993).

Lesoult, G., "Macrosegregation in Steel Strands and Ingots: Characterisation, Formation and Consequences," Materials Science and Engineering A, vols. 413-414, pp. 19-29 (2005).

Miaoyong, Z. et al., "Dynamic Soft Reduction in Continuous Casting Process," China Academic Journal Electronic Publishing House, pp. 332-336 (2005).

Miyazawa, K., "Continuous Casting of Steels in Japan," Science and Technology of Advanced Materials, vol. 2, No. 1, pp. 59-65 (2001).

* cited by examiner

【Figure 1】
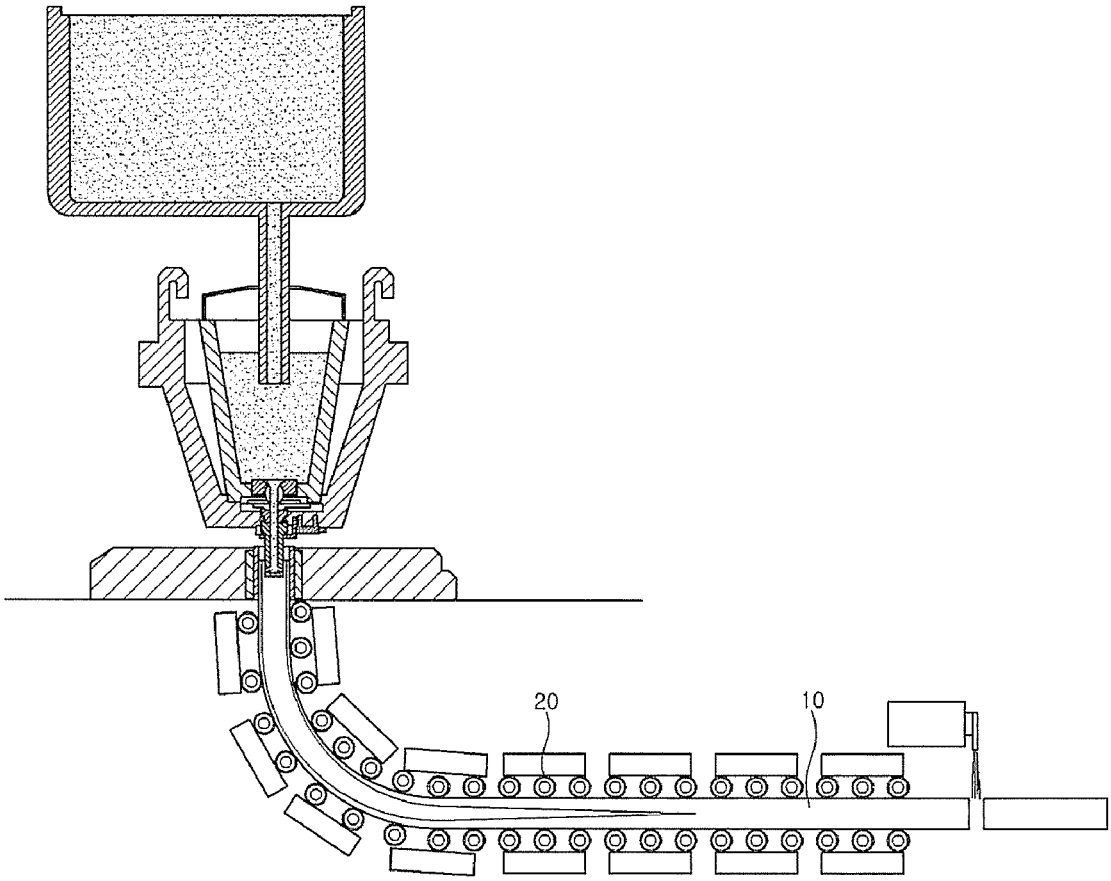
【Figure 2】
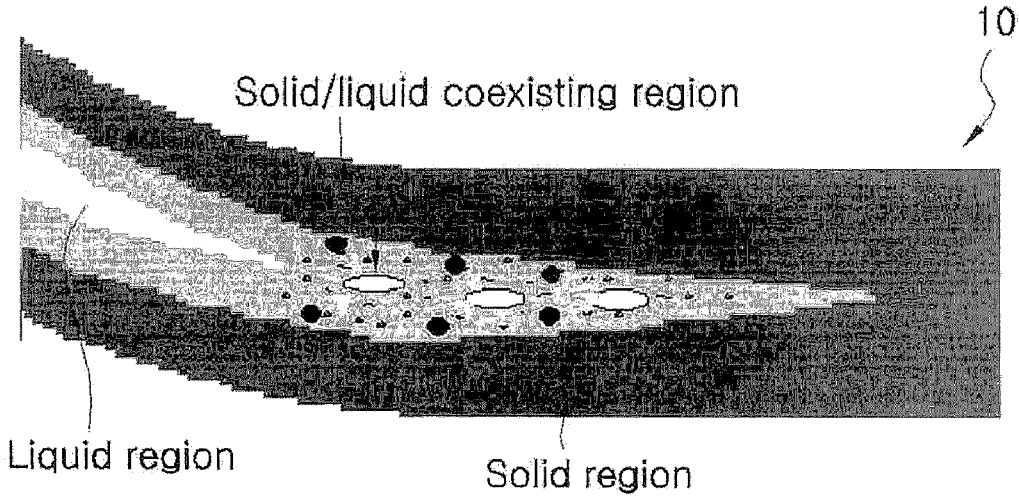

【Figure 3】
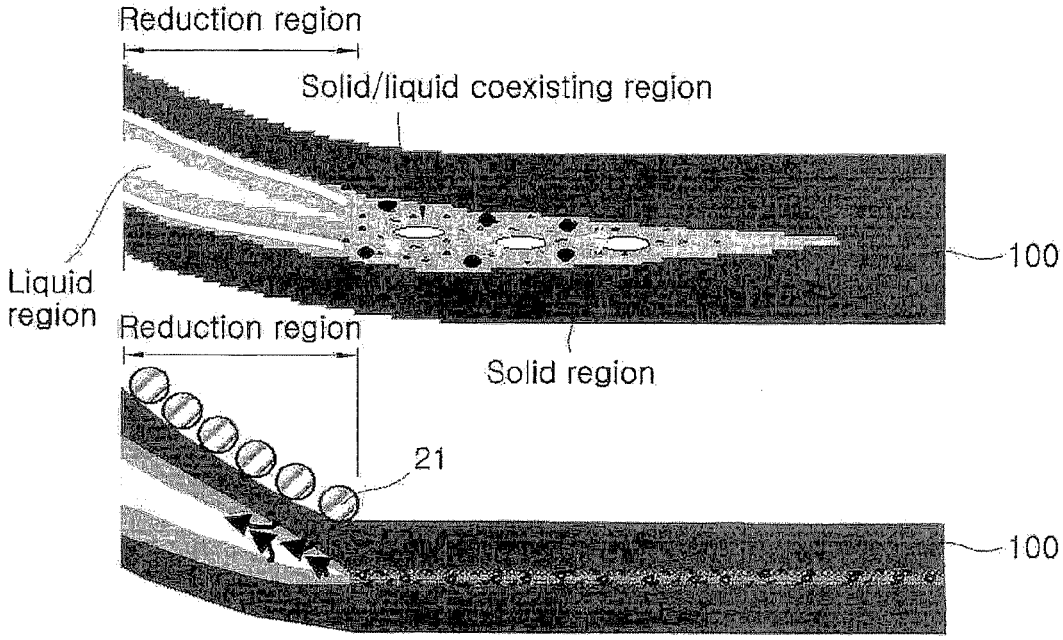
【Figure 4】
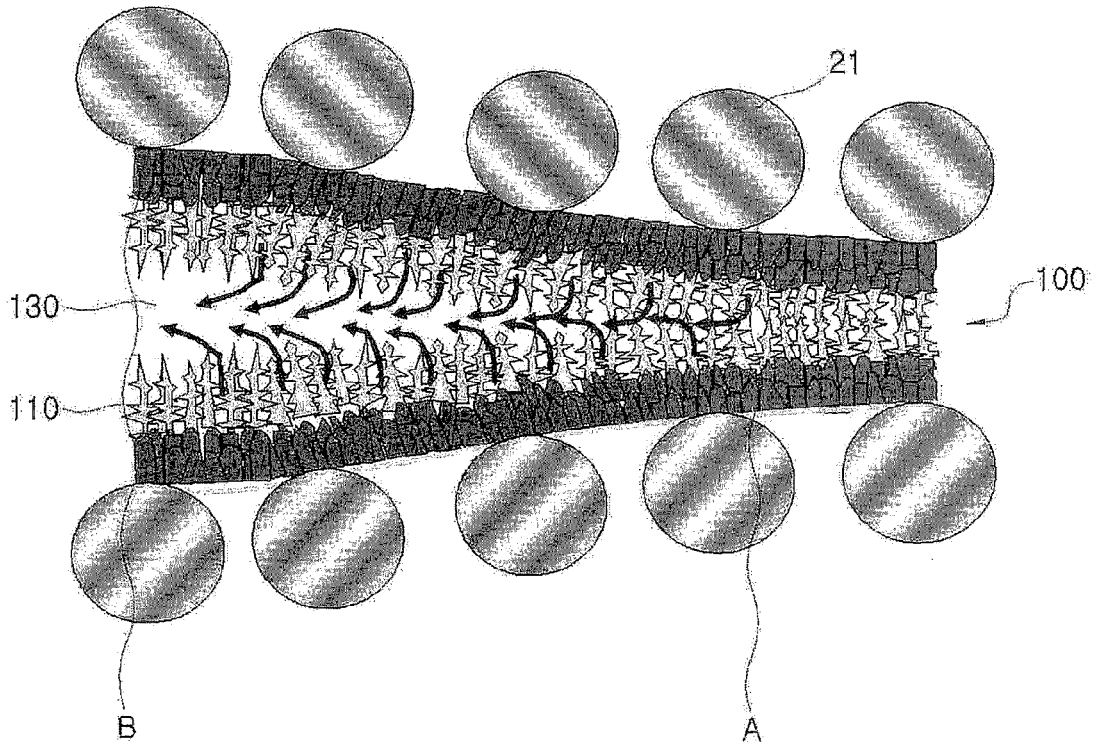

【Figure 5】
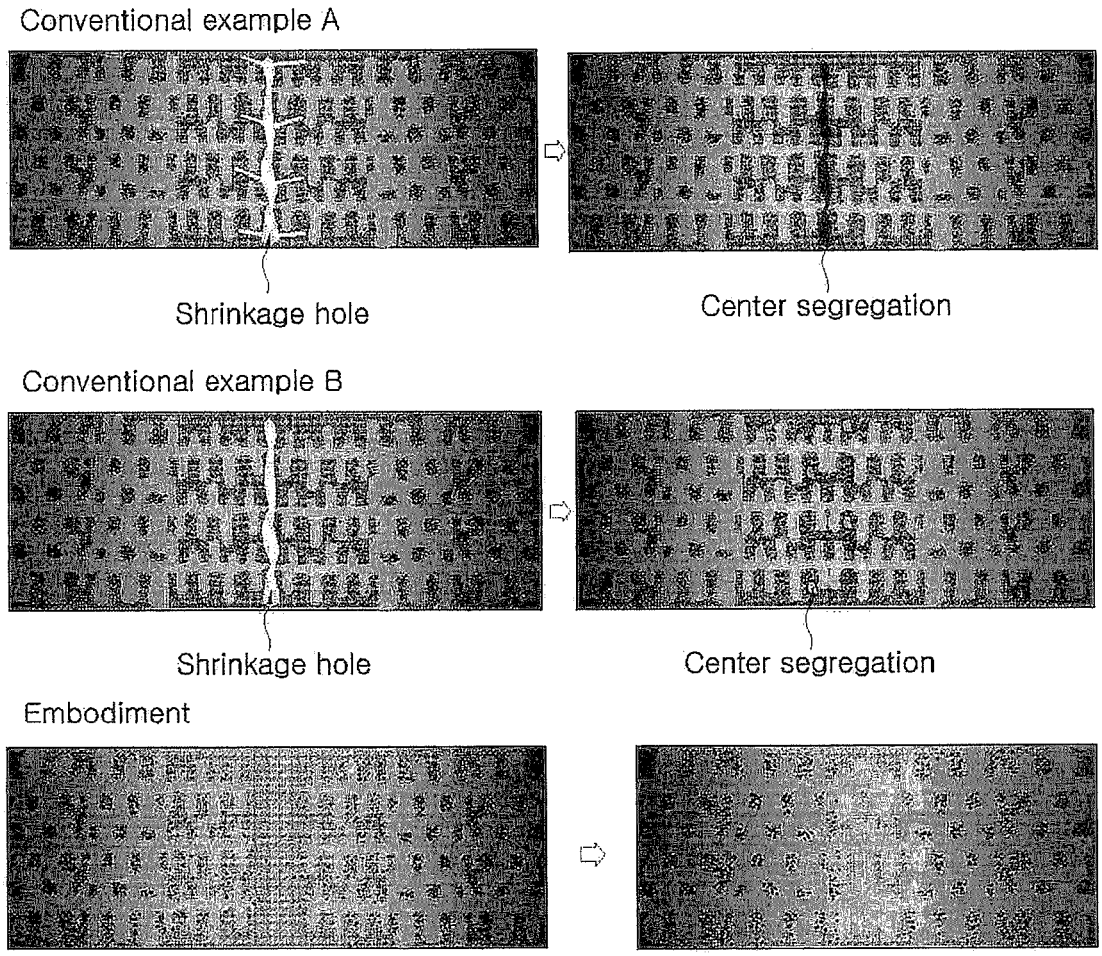

【Figure 6】
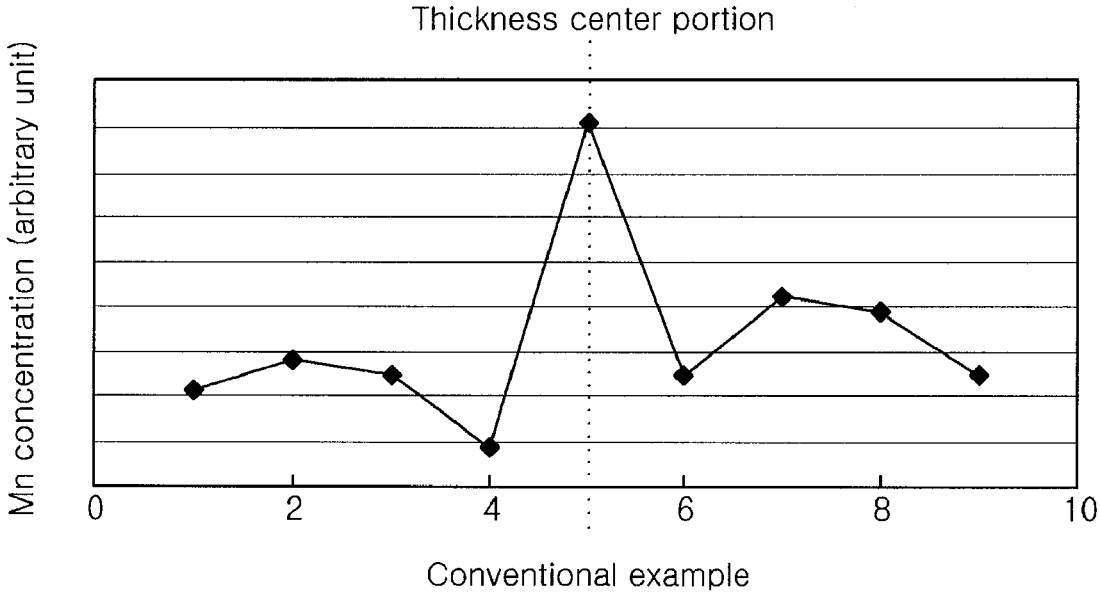
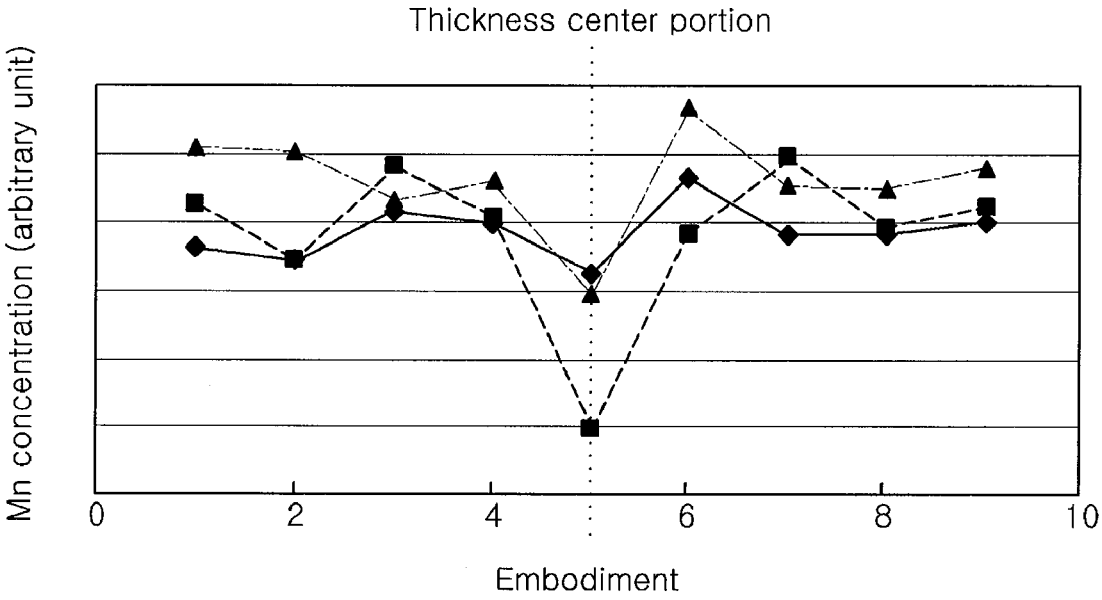

【Figure 7】
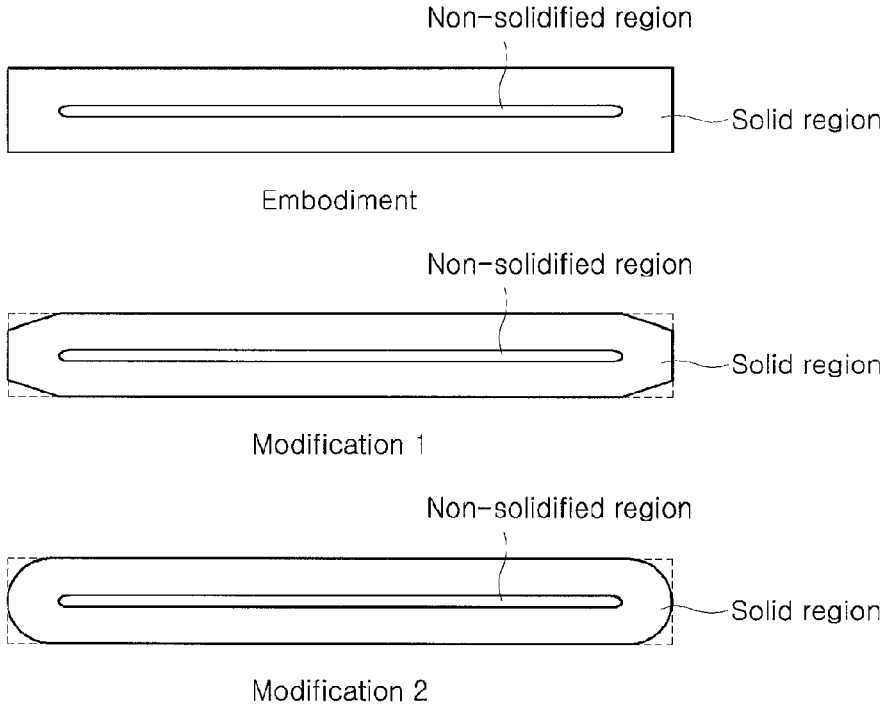
【Figure 8】
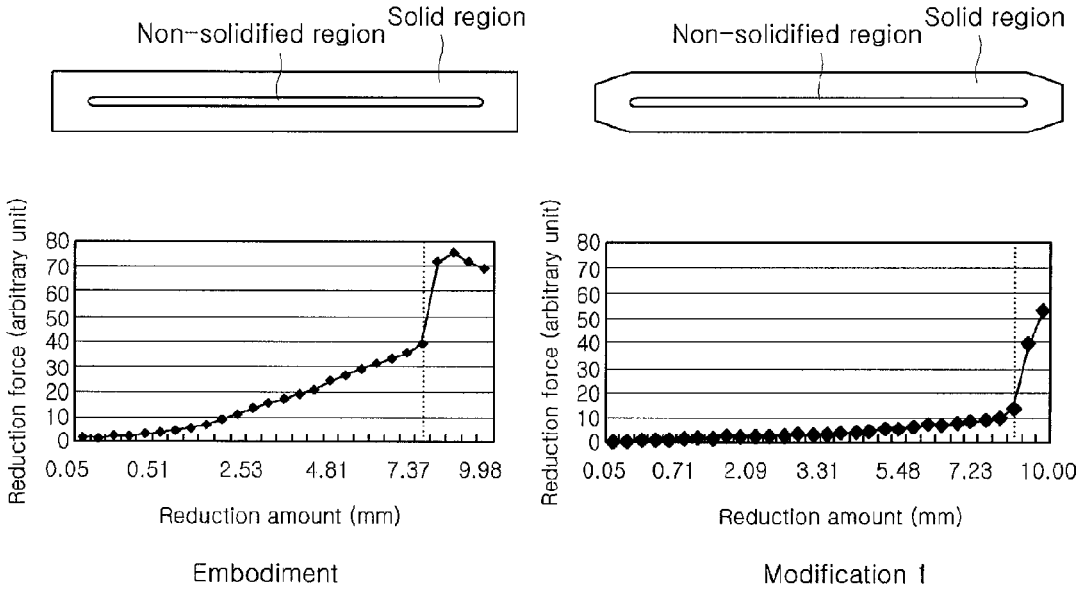

CONTINUOUS CAST SLAB AND METHOD FOR MANUFACTURING THE SAME

TECHNICAL FIELD

The present invention relates to a continuous cast slab and a manufacturing method for the same, and more particularly, to a continuous cast slab and a manufacturing method for the same, wherein solidified layers of a cast slab having a non-solidified layer are compressed with each other during a continuous casting process to fundamentally prevent occurrence of defects, such as center segregation or porosity, which deteriorate quality of the cast slab, thereby decreasing defects.

BACKGROUND ART

Generally, a cast slab is made in such a manner that molten steel received in a mold is cooled through a cooling unit, which is shown in FIG. 1. A continuously cast slab 10 is cooled while passing through at least one segment 20 and then progresses to a following process. When the cast slab is rolled into a thick steel plate, the defect of the cast slab may remain even after the rolling, which may cause inferiority. This defect may be center segregation and porosity, for examples. The center segregation occurs by the flow of solute enriched in the residual molten steel in the final stage of solidification when a slab is continuously cast. The major factor of this flow is cast slab bulging and solidification shrinkage of residual molten steel. However, the center segregation is most influenced by the flow of residual molten steel caused by the solidification shrinkage near a solidification end point, except for the cast slab bulging caused by mechanical factors. That is, if residual molten steel with enriched solute (referred to as so-called 'solute-enriched molten steel') is collected in a solidification shrinkage region near the solidification end point in the continuous casting process, this becomes center segregation. If the solidification shrinkage region is not filled but remains as a space, it becomes center porosity.

A representative technique for decreasing defects such as center segregation and porosity is soft reduction process. The soft reduction is to endow reduction force to a cast slab 10 by the segment 20 during a continuous casting process. The cast slab 10 is reduced as much as the solidification shrinkage at the end of solidification stage to physically compress a shrinkage cavity, whereby solute-enriched molten steel existing between columnar dendrites by solidification shrinkage is restrained from being introduced into a thickness center area of the cast slab to thereby improve center segregation of the cast slab.

FIG. 2 is a sectional view showing a cast slab in a casting direction during a continuous casting process.

The essence of the above soft reduction is that weak pressure is applied to a solid/liquid coexisting region, so called a mushy zone (having a solid fraction from 0.3~0.4 to 0.7~0.8), where center segregation is formed by residual molten steel collected in and around a shrinkage cavity, which is formed during a solidification process. However, the soft reduction applied at the point where a shrinkage cavity is formed has the following problems.

First, the soft reduction technique allows a small reduction amount (a total reduction amount: 3~5 mm), and allows equiaxed dendrites to be easily formed at the thickness center portion of the cast slab at the end of solidification stage. In this case, the reduction force at a surface region of the cast slab is not easily transmitted to the thickness center region of the cast slab (a reduction efficiency is about 20%), so that the shrinkage cavity is not fully compressed. Accordingly, residual molten steel in which a solute is enriched may be collected in the partially uncompressed shrinkage hole to form a small center segregation, or a porosity remains in the thickness center portion of the cast slab. Also, the continuous cast slab causes solidification irregularity in a slab width direction during the casting process, and if the cast slab is softly reduced, the reduction force is changed depending on a position in the slab width direction, so that it is difficult to uniformly compress a shrinkage cavity over the entire cast slab to eliminate defects. In addition, the reduction force does not reach a center portion of the cast slab spaced apart from an edge of the cast slab by a predetermined distance due to the influence of the solidified layers formed at marginal portions of the cast slab. As a result, the interior quality is greatly changed in a slab width direction, and center segregation or center porosity happens near the slab center portion, so that defects occur intensively at a local portion of the thick steel plate.

Due to the above reasons, the existing soft reduction has a limitation in controlling center segregation, when it is used singly. For improvement, the following methods have been proposed.

First, there has been proposed a method wherein after applying soft reduction to a region having a solid fraction from 0.3~0.4 to 0.7~0.8, at least one pair of additional rolls are installed at the end location of solidification stage corresponding to the solid fraction of 0.8~1.0 and heavy rolling is performed. In this method, the existing soft reduction is applied as it was, and then the following region of the cast slab is rolled using rolls, where center segregation is in the same level as the existing soft reduction. However, in this method, when solidification irregularity occurs in a slab width direction, interior quality control is difficult in the width direction. In addition, equipment remodeling for installing rolls is required, and the final solidification portion should be identically arranged at a location where the rolls are installed. Thus, this method has a fundamental limitation in that it cannot cope with a location of solidification finishing point, which varies according to a change in slab width or other work conditions such as casting speed change.

In the conventional technique as mentioned above, a thick cast slab at the end of solidification stage is heavily rolled using additional rolls, so that since great reduction force is required, rolls should be essentially installed. When a cast slab is reduced by means of rolls, both end sides of the cast slab are already in a fully solidified solid state. Thus, when reduction is executed using the rolls, the fully solidified solid layer is reduced, whereby the great reduction force is required such that the reduction force can be transmitted up to the center of the cast slab.

In addition, since a great reduction of 3 to 15 mm is applied to a cast slab (the entire of which is substantially solidified) in order to reduce porosities occurring in the slab center portion with a solid fraction of 0.8 or above, the extremely great reduction force is required. Accordingly, if rolls which are not reinforced are used for applying the great reduction force, the rolls may be broken. Thus, there has been proposed a technique for reinforcing rigidity of rolls by increasing a diameter of rolls from 300 mm to 450 mm, as a countermeasure. However, this method cannot also avoid deterioration of interior quality (occurrence of interior cracks) of the continuous cast slab according to the increase of roll pitch of the continuous casting machine. That is, the bulging that gives a great influence on occurrence of interior cracks and center segregation of the continuous cast slab is proportional to the fourth power of the roll pitch of the continuous casting machine, and the rolls of the continuous casting machine is substituted with rolls with a great diameter as mentioned above, so that the quality of the continuous cast slab is inevitably deteriorated under the casting conditions using the rolls for the continuous casting machine since a casting speed is changed when producing different kinds of general steels using the same continuous casting machine. In addition, if the cast slab is heavily rolled using the rolls after the soft reduction is applied, the center segregation is more enriched. That is, even when the soft reduction is applied, the center segregation remains in the thickness center portion to some extent, and if the cast slab is heavily rolled using the rolls in this state, the center segregation portion is also rolled, thereby increasing the degree of solute enrichment in the center segregation portion and also changing the residual shape into a sharp linear form. In this case, properties of the rolled steel are easily deteriorated after the rolling work.

DISCLOSURE

Technical Problem

The present invention provides a continuous cast slab, wherein defects deteriorating quality of a cast slab are eliminated by pushing solute-enriched residual molten steel of the cast slab in an opposite direction to a casting direction during a continuous casting process, and a manufacturing method for the same.

Technical Solution

There is provided a method for manufacturing a continuous cast slab with a thickness of 100 mm or more using a continuous casting machine, wherein when a cast slab is continuously casted using at least one segment having a plurality of upper and lower rolls facing each other in a thickness direction of the cast slab, a region of which solid fraction is in the range of 0.05~0.2 to 0.3~0.6 in a center portion of the cast slab is reduced in the thickness direction of the cast slab, a reduction gradient of the segment is set to 5 to 20 mm per 1 m length in a casting direction, and a reduction amount of the segment is increased along downstream of the casting direction to let solute-enriched residual molten steel flow back in an opposite direction to the casting direction so that the center portion of the cast slab has negative segregation.

Here, there may be provided at least two segments, and the segments may have the same reduction gradient or different reduction gradients.

Also, there may be provided at least two segments, and among the segments, the segment located downstream in the casting direction may have a greater reduction gradient than the segment located upstream in the casting direction.

Further, a final roll of the segment may have a reduction ratio of 0.9 to 1.1. When the cast slab has a center solid fraction of 0.3 to 0.6, a solid fraction of the cast slab compressed in the thickness direction may be 0.9 or more.

In addition, a reduction rate of the cast slab by the segment may be 3 to 30 mm/min. An overheating temperature of the molten steel is less than 20° C. before the molten steel is inputted into the mold At this time, at least one edge of the cast slab may be chamfered.

In addition, at least a part of solute-enriched residual molten steel remaining in the center portion of the cast slab with a solid fraction of 0.3 to 0.6 may be moved to a region of the center portion with a solid fraction of 0.2 or less. At least one electromagnetic stirring unit may be installed between the mold and the reduction segment to stir the backflow molten steel in the cast slab by electromagnetic force.

A continuous cast slab according to the present invention is manufactured by a method for manufacturing a continuous cast slab with a thickness of 100 mm or more using a continuous casting machine, wherein when a cast slab is continuously casted using at least one segment having a plurality of upper and lower rolls facing each other in a thickness direction of the cast slab, a region of which solid fraction is in the range of 0.05~0.2 to 0.3~0.6 in a center portion of the cast slab is reduced in the thickness direction of the cast slab, a reduction gradient of the segment is set to 5 to 20 mm per 1 m length in a casting direction, and a reduction amount of the segment is increased along downstream of the casting direction to let solute-enriched residual molten steel flow back in an opposite direction to the casting direction so that the center portion of the cast slab has negative segregation.

Here, the center portion of the cast slab may have negative segregation of $C/Co<1$.

Advantageous Effects

A continuous casting method according to the present invention may decrease defects such as center segregation or porosity formed at a slab center portion which deteriorates the interior quality of the cast slab during a continuous casting process. That is, while the cast slab is solidified, solids such as dendrites are compressed with each other to push solute-enriched residual molten steel existing between the solids toward a position where a mold is positioned, thereby eliminating defects such as center segregation and thus producing a cast slab whose defects are greatly decreased.

In addition, the continuous casting method does not require any remodeling of the continuous casting machine such as addition installation of rolls. Also, since the continuous casting method is applied in the unit of continuous machine segment, it is possible to control defects over the entire width even though solidification irregularity occurs in a width direction of the cast slab. Further, dynamic control is possible responding to a variable solidification end position caused by the change of casting conditions.

DESCRIPTION OF DRAWINGS

FIG. 1 is a schematic view showing a continuous casting machine.

FIG. 2 is a sectional view showing a cast slab in a casting direction during a continuous casting process.

FIG. 3 schematically illustrates a continuous casting method according to an embodiment of the present invention.

FIG. 4 is a view showing a phenomenon occurring in a reduction region of FIG. 3.

FIG. 5 comparatively shows cross sections of cast slabs according to conventional examples and an embodiment of the present invention.

FIG. 6 shows solute concentration distributions in cross sections of completely solidified cast slabs manufactured according to a conventional example and an embodiment of the present invention.

FIG. 7 shows cross sections of cast slabs according to an embodiment and modifications of the present invention.

FIG. 8 comparatively shows cross sections of modification 1 and an embodiment of the present invention in which a solid region is reduced in a cross section.

BEST MODE

Hereinafter, a continuous cast slab and a manufacturing method for the same according to embodiments of the present invention will be described in detail with reference to the accompanying drawings. However, the present invention is not limited to the following embodiments but may be implemented in various ways, and the following embodiments are just for perfecting the disclosure of the invention and understanding the scope of the invention fully to those having ordinary skill in the art.

A cast slab made using a continuous casting machine is manufactured by cooling molten steel received in a mold. The molten steel has a predetermined shape while being drawn from the mold and is made into a solid cast slab through gradual cooling in a drawing direction by means of contact with the atmosphere or an additional cooling means. At this time, the cast slab is solidified from an outside of its bulk, i.e., from a surface thereof and has a region where liquid molten steel exists. Such a liquid region in the cast slab is gradually reduced as the liquid molten steel is solidified traveling away from the mold, i.e., traveling in a casting direction. Finally, only a solid region remains in the cast slab in its cross section. Before the solidification is completed, a mushy zone where solid and liquid coexist is present in the cast slab, and the mushy zone is solidified into a solid as the casting work progresses. At this time, in the mushy zone, so-called solute-enriched residual molten steel where predetermined elements are thickened is solidified, and as the liquid is solidified into a solid, a solidification shrinkage portion occurs according to the reduction of volume.

In addition, if the solute-enriched residual molten steel is introduced into the solidification shrinkage portion due to negative pressure caused by the creation of the solidification shrinkage cavity, a large center segregation may be formed, which may act as a defect. The solidification shrinkage cavity and the solute-enriched residual molten steel remain as they were even after the solidification end point at which solidification is completed in a cross section of the cast slab, thereby causing defects such as porosity or center segregation, which makes properties of the cast slab irregular and thus deteriorates the quality of a final product.

FIG. 3 schematically illustrates a continuous casting method according to an embodiment of the present invention, and FIG. 4 is a view showing a phenomenon occurring in a reduction region of FIG. 3.

Referring to FIG. 3, a continuous casting method according to an embodiment of the present invention is used for producing a cast slab 100 by drawing molten steel from a mold, and includes a step of preparing a compressing unit 21 and a step of reducing at least one side of the drawn cast slab 100 using the compressing unit 21 such that the solute-enriched residual molten steel flows back in a direction opposite to the casting direction. This technique will be referred to as 'segment squeezing reduction' in comparison to a conventional soft reduction. In the conventional soft reduction, a solid/liquid coexisting region of a cast slab was reduced to compress the generated solidification shrinkage hole. However, in the segment squeezing reduction, a liquid region, i.e., a region with a solid fraction from 0.05~0.2 to 0.3~0.6 shown as a reduction region in FIG. 3, is reduced, thereby causing solute-enriched residual molten steel to flow back and fundamentally preventing occurrence of a solidification shrinkage cavity. The squeezing reduction region with a solid fraction from 0.05~0.2 to 0.3~0.6 is positioned at a location more backward than the mushy zone (with a solid fraction from 0.3~0.4 to 0.7~0.8), at which pressure is applied in the soft reduction technique, in a continuous casting direction, and a solidification shrinkage cavity is not yet generated in this squeezing reduction region.

That is, the solute-enriched residual molten steel is caused to flow back to a liquid region that relatively allows mixing homogenization by free flow of the molten steel (in a B direction of FIG. 4), before being condensed/grown or introduced into the solidification shrinkage cavity. In other words, at least a part of the solute-enriched residual molten steel in a region with a solid fraction of 0.3~0.6 is caused to flow back to molten steel free flow region having a solid fraction of 0.2 or less. The solute-enriched residual molten steel flowing back to the molten steel free flow region is dispersed by mixing homogenization in the molten steel, and the homogenized molten steel moves in a casting direction again and is then solidified. Thus, the solute-enriched residual molten steel in which a defect such as center segregation may occur at the completion of solidification does not exist in the mushy zone where solid and liquid coexist, thereby preventing any defect from occurring when the mushy zone is solidified.

In order that the solute-enriched residual molten steel may be caused to flow back to the liquid region where the molten steel may freely move, at least one side of the cast slab 100 may be reduced as shown in FIG. 3. If the cast slab 100 is compressed by some external equipments thereof, the solute-enriched residual molten steel is not introduced into a region where solidification is completed, i.e., in a casting direction, but the solute-enriched residual molten steel flows toward the liquid molten steel, i.e., toward the mold, so that it flows back in a direction (an arrow direction in FIG. 4) opposite to the casting direction. For better backflow of the solute-enriched residual molten steel, the cast slab 100 may be reduced from the solid/liquid coexisting region in the cast slab 100 to the liquid region, that is, a region toward the mold may be reduced. This region is shown as a reduction region in FIG. 3, which covers approximately from A to B in FIG. 4. At this time, the cast slab 100 may be reduced in a region where a solidification shrinkage portion is not yet formed. If defects such as center segregation is prevented from occurring by causing the solute-enriched residual molten steel to flow back and the cast slab 100 is compressed before a solidification shrinkage portion is formed, it is possible to prevent or minimize occurrence of a solidification shrinkage portion that is created along with volume shrinkage caused by solidification.

By reducing the reduction region of the cast slab 100, shown in FIG. 3, during the continuous casting process, before a shrinkage cavity is generated, solidified layers in which dendrites 110 are grown may be compressed to contain a non-solidified layer 130, thereby preventing occurrence of a shrinkage cavity. Also, the solute-enriched residual molten steel may be caused to flow back to the molten steel free flow region toward the mold, so that defects may be substantially not generated even after the solidification end point.

In order to prevent occurrence of defects of the cast slab 100 in a more effective way, at least one stirring unit may be installed in a region between the mold and the reduction region, whereby the backflow molten steel is stirred to ensure more homogenized solute distribution. At this time, the stirring unit may include an electromagnetic stirring unit, and in this case, the backflow molten steel is stirred using electromagnetic force.

The cast slab 100 may be reduced in a region where a solid fraction of the cast slab 100, i.e., a fraction occupied by solid in a cross section, in more detail a fraction occupied by solid in the center portion of the cast slab 100 in a cross section, is from 0.05~0.2 to 0.3~0.6 (a left side region in A of FIG. 4). In order to prevent occurrence of defects, the cast slab 100 should be reduced in a region with a sufficiently low solid fraction such that the solute-enriched residual molten steel may flow back easily. That is, if a region in which a thickness center portion of the cast slab has a solid fraction of 0.6 or more is reduced, since liquid solute-enriched residual molten steel is in a state of being surrounded by solid, the cast slab is elongated in a rolling direction only in its shape and then the molten steel remains as it was, which becomes a defect of center segregation. Thus, the cast slab 100 is preferably reduced in a region with a solid fraction less than 0.6.

In addition, the cast slab 100 is reduced, whereby the solute-enriched residual molten steel may be caused to flow back to a region with a solid fraction less than 0.2, i.e., to a left side region in B of FIG. 4. If the solute-enriched residual molten steel flows back to a region with a solid fraction over 0.2, the molten steel cannot easily flow in this region, which may deteriorate mixing homogenization of the solute-enriched residual molten steel. Thus, the solute-enriched residual molten steel is preferably caused to flow back to the region with a solid fraction less than 0.2.

The reduction work of the cast slab 100 may be performed using segments 20 (see FIG. 1) of a continuous casting machine. That is, the cast slab 100 may be reduced by utilizing an existing continuous casting equipment as it is, which allows reduction of costs caused by addition of equipments such as rolls and also allows production of a cast slab with sufficiently decreased defect only using an existing continuous casting equipment. At this time, according to a type of produced steel, thickness of cast slab, solidification end point and the like, the cast slab 100 may be reduced using a single segment having many (generally, five to nine) rolls 21 or a plurality of the segments in combination, and the reduction region may be varied.

The reduction of the cast slab 100 using the segments of a continuous casting machine may be performed by arranging the plurality of rolls 21 mounted to a single segment so that the reduction gradient is identical along a casting direction; or by arranging the rolls to be inclined so that the reduction gradient can be different from each other. Also, the reduction may be performed by arranging a plurality of segments so that the reduction gradient is identical along a casting direction; or by arranging the segments to be inclined so that the reduction gradient can be different from each other. For example, the segment located downstream in the casting direction may be set to have a greater reduction gradient than the segment located upstream. If the segment has greater reduction amount in a casting direction, it is possible to effectively prevent the solute-enriched residual molten steel from being introduced in a casting direction while the cast slab 100 is reduced.

By means of the segment, the cast slab 100 preferably has a reduction gradient of 5 to 20 mm per 1 m length of the cast slab 100 in a casting direction of the cast slab 100 having a thickness of 100 mm or more. If the reduction gradient is less than 5 mm, the driving force for causing the solute-enriched residual molten steel to flow back is not sufficient, and the backflow solute-enriched residual molten steel may be reintroduced. Also, if the reduction gradient exceeds 20 mm, the cast slab 100 may crack due to the excessive reduction gradient.

When the cast slab 100 is reduced by means of the segments, a reduction amount of the cast slab 100 may be 3 to 40% of the thickness of the cast slab 100 which has a thickness of 100 mm or more. For example, when the cast slab 100 has a thickness of 100 mm or more, 3 to 40 mm may be reduced. With a reduction amount less than 3%, the solute-enriched residual molten steel may not sufficiently flow back to the molten steel free flow region. If a reduction amount exceeding 40% is applied, the thickness of the cast slab 100 may be too reduced, which may give a bad influence on production of a thick plate. Thus, the reduction amount is preferably 3 to 40% of the thickness of the cast slab 100. However, the reduction amount is not limited thereto but may be varied depending on the kind of a produced cast slab 100. When the cast slab 100 has a thickness of 100 mm, a reduction amount of 3 to 40 mm corresponds to a case where a height difference between an entrance roll and an exit roll of each of two segments which has a length of 1 m and five rolls is 20 mm and a casting speed is 1.5 m/min, so the reduction amount may be varied depending on other continuous casting conditions.

A reduction rate of the cast slab 100 using the segments may be 3 to 30 mm/min. If the cast slab 100 is reduced at a reduction rate lower than 3 mm/min, the solute-enriched residual molten steel may not easily flow back but remain, which may cause center segregation. At a reduction rate exceeding 30 mm/min, the reduction amount is excessively increased, so that a cast slab thickness is too decreased, which makes it difficult to produce a thick plate. Thus, it is suitable that a reduction rate is not greater than 30 mm/min.

In addition, a final segment among a plurality of segments, or a final roll of a single segment, preferably has a reduction ratio of 0.9 to 1.1, which is namely a ratio of the reduction amount to a non-solidified thickness. In a case where a final roll has a reduction ratio less than 0.9, the non-solidified region excessively remains, so that the solute-enriched residual molten steel or the shrinkage cavity in this region may remain as defects in the cast slab 100. Thus, a reduction ratio at the final roll should be at least 0.9, and the reduction is suitably accomplished to have up to a reduction ratio of 1.1, which is greater than the thickness of the non-solidified region. In a case where a reduction work is performed at a reduction ratio exceeding 1.1, a crack may occur since both solidification regions of the cast slab 100 may collide.

In other case, the compressed cast slab 100, which is compressed by the reduction in a region with a central solid fraction of 0.3 to 0.6, preferably has a solid fraction of 0.9 or more. In a case where the solid fraction is less than 0.9, the non-solidified region excessively remains, so that the solute-enriched residual molten steel or the shrinkage hole in this region may remain as defects in the cast slab 100, or the solute-enriched residual molten steel may be reintroduced into the non-solidified region before the non-solidified region is solidified.

Meanwhile, when molten steel is poured into a mold to perform the continuous casting process, the superheat temperature of the molten steel is preferably less than 20° C. That is, molten steel is preferably inputted into a mold at a temperature not 20° C. higher than a temperature at which the molten steel initiates solidification from liquid to solid. In a case where the temperature of the molten steel inputted into the mold is higher by 20° C. or more, an internal crack may be more easily created.

Hereinafter, a conventional example is compared with the embodiment of the present invention.

FIG. 5 comparatively shows cross sections of cast slabs according to conventional examples and an embodiment of the present invention. The conventional example A exhibits a non-reduced cast slab, the conventional example B exhibits a soft-reduced cast slab, wherein a left side exhibits a state before a solidification end point, and a right side exhibits a state after the solidification end point.

Referring to FIG. 5, if the continuous casting process is performed without reducing a cast slab, as in the conventional example A, a shrinkage cavity is formed in a mushy zone, and solute-enriched residual molten steel is introduced into the shrinkage cavity and then the cast slab is solidified, so that the solute-enriched residual molten steel remains as center segregation after the solidification end point.

In the conventional example B where the soft reduction is performed, dendrites grown into the cast slab from both end sides of the cast slab are compressed by the reduction force, thereby decreasing the center segregation area. However, in this case, the cast slab is reduced after the solute-enriched residual molten steel is already introduced into the shrinkage cavity, so that center segregation still remains partially.

In the embodiment of the present invention, the cast slab is reduced before a shrinkage cavity is generated, so that the solidified layers in which dendrites are grown are compressed together with a non-solidified layer, thereby generating no shrinkage cavity. Also, the solute-enriched residual molten steel flows back to the molten steel free flow region toward the mold, so that substantially no defect occurs even after the solidification end point.

As for conditions of the present invention, a cast slab having a thickness of 100 to 140 mm was made at a casting speed of 0.8 to 2 m/min and a reduction gradient of about 2.5 to 25 mm/m with the position of the segments varied. FIG. 6 illustrates solute concentration distributions in cross sections of the solidified cast slabs prepared according to the conventional example and the embodiment of the present invention. In FIG. 6, the embodiment of the present invention is conducted under the condition of a reduction rate of 3 to 10 mm/min.

As shown in FIG. 6, it would be understood that the concentration of Mn is rapidly increased at the thickness center portion in the conventional example. That is, solute such as Mn is concentrated at the cast slab center portion, thereby being formed into a larger segregation. However, in the embodiment of the present invention, it would be found that solute distribution is relatively regular in a cross section of the cast slab, and particularly solute concentration is rather decreased in the center portion of the cast slab, which is called negative segregation. That is, there appears a region where a ratio of a cast slab center concentration C to an entire cast slab concentration (Co) is 1 or less ($C/Co<1$). However, if the reduction gradient exceeds 20 mm/m, the cast slab starts to crack. Also, if the reduction rate is 3 mm/min or less, it is difficult for the molten steel to flow back, and if the reduction rate exceeds 30 mm/min, the slab thickness is excessively decreased, which may make it difficult to produce a thick plate in an actual process.

Using such cast slab reduction, it is possible to greatly decrease defects such as center segregation or porosity. When a cast slab is reduced as mentioned above, reduction resistance acts on the cast slab as a reaction against the reduction force. That is, since a cast slab is reduced in a state where an outer portion of the cast slab is solidified, a more efficient reduction method is required to uniformly reduce the already solidified region of the cast slab with smaller force. In particular, in order to use the segments of an existing continuous casting machine as they are, it is required to efficiently transmit the reduction force to the cast slab. To this end, the cast slab may have a partially modified shape.

FIG. 7 shows cross sections of cast slabs according to an embodiment and modifications of the present invention. In this embodiment, the cast slab has a non-solidified region generally at its center portion, and an outer periphery of the cast slab has a generally rectangular shape. In this case, both the end sides of the cast slab have solidification regions without a non-solidified region. Thus, when the cast slab is reduced, the reduction force applied to the cast slab is not uniformly transmitted to the entire cast slab but concentrated on both the ends of the cast slab, whereby great reduction force is required for reducing the cast slab.

In the modification 1 of the present invention, both the end sides of the cast slab are chamfered, and in the modification 2 of the present invention, both the end sides of the cast slab are rounded. That is, in the modifications of the present invention, the cast slab may have a shape in which a solidification region is decreased rather than the cast slab of the embodiment, in a cross section. If the solidification region of the end side is decreased as mentioned above, the reduction force concentrated on both the end sides may be uniformly transmitted to the entire cast slab. In addition, when a surface of the cast slab is reduced, the reduction resistance is decreased, and thus the reduction force may be further decreased rather than a case of the embodiment. In order to obtain a cast slab shape as in the modifications of FIG. 7, a mold of the continuous casting machine may be designed to conform to the cast slab shape. That is, a mold of the continuous casting machine may have a shape in which at least one edge is chamfered or at least one end is rounded in aspect of its cross section of the drawn molten steel.

FIG. 8 comparatively shows cross sections of an embodiment and modification 1 of the present invention in which a solid region is reduced in a cross section. In the embodiment of FIG. 8, the variation of reduction force of a cast slab having a generally rectangular cross section was measured. Also, in the modification 1, the variation of reduction force according to the reduction amount of a cast slab in which each edge is chamfered as much as 20 mm in height and 60 mm in width in its cross section was measured. As for conditions of the present invention, a cast slab having a thickness of 100 to 140 mm was made at a casting speed of 0.8 to 2 m/min and a reduction gradient of about 2.5 to 25 mm/m with the position of the segments changed. In the modification 1, in order to make a chamfered shape, a mold conforming to the chamfered shape was used to continuously cast a slab. The reduction force is expressed based on an arbitrary unit. In the graph, a right side region with respect to a dotted line exhibits a region where solid regions at both the sides of the non-solidified region are in contact with each other and thus the reduction force is rapidly increased. In the graph, a left side region with respect to the dotted line exhibits a region where the non-solidified region is compressed due to the reduction of the cast slab. The reduction force of the cast slab is gradually increased as the non-solidified region is compressed.

As shown in FIG. 8, the modification 1 of the present invention has a maximum reduction force of about 20 or less. It would be understood that the maximum reduction force is substantially a half or less of a maximum reduction force of about 40 of the embodiment. In addition, as compared with the gradient of the reduction force in the embodiment, it would be found that the gradient of the reduction force in the modification 1 is smaller. That is, in a case where reduction is performed after decreasing a solid region in the cross section of the cast slab by forming a chamfered shape or the like, the reduction force may be greatly decreased. The decreased reduction force prevents excessive load on the segments of the continuous casting machine, which makes it possible to easily perform the continuous casting. In addition, without any additional equipment such as rolls, a cast slab may be easily reduced using the existing continuous casting machine, thereby making it possible for the solute-enriched residual molten steel to easily flow back.

Although the spirit of the present invention has been described in detail based on the preferred embodiments, the embodiments are only for illustrative purposes and not intended to limit the scope of the invention. Also, it will be apparent that those skilled in the art can make various modifications and changes thereto within the scope of the invention defined by the claims.

In particular, although it has been illustrated in the embodiment that a cast slab is compressed using segments of a continuous casting machine, an additional roll equipment may be further employed for causing solute-enriched residual molten steel to flow back in a direction opposite to a casting direction if necessary.

In addition, although it has been illustrated in the embodiment that a cast slab has a thickness of 100 to 140 mm, other cast slabs with different thicknesses may also be applied, and reduction conditions may also vary accordingly. In particular, numerals in the embodiments of the present invention are based on a cast slab for a thick plate, and the numerals may vary in a case where a cast slab has another purpose, such as for a thin plate.

The invention claimed is:

1. A method for manufacturing a continuous cast slab with a thickness of 100 mm or more using a continuous casting machine, wherein when a cast slab is continuously casted using at least one segment having a plurality of upper and lower rolls facing each other in a thickness direction of the cast slab, a region of which solid fraction is in the range of 0.05~0.2 to 0.3~0.6 in a center portion of the cast slab is reduced in the thickness direction of the cast slab, a reduction gradient of the segment is set to 5 to 20 mm per 1 m length in a casting direction, and a reduction amount of the segment is increased along downstream of the casting direction to let solute-enriched residual molten steel flow back to a molten steel free flow region toward an opposite direction to the casting direction so that the center portion of the cast slab has negative segregation.

2. The method as claimed in claim 1, wherein there are provided at least two segments, and the segments have the same reduction gradient or different reduction gradients.

3. The method as claimed in claim 1, wherein there are provided at least two segments, and among the segments, the segment located downstream in the casting direction has a greater reduction gradient than the segment located upstream in the casting direction.

4. The method as claimed in claim 1, wherein a final roll of the segment has a reduction ratio of 0.9 to 1.1.

5. The method as claimed in claim 1, wherein when the cast slab has a center solid fraction of 0.3 to 0.6, a solid fraction of the cast slab compressed in the thickness direction is 0.9 or more.

6. The method as claimed in claim 1, wherein a reduction rate of the cast slab by the segment is 3 to 30 mm/min.

7. The method as claimed in claim 1, wherein an overheating temperature of the molten steel is less than 20° C. before the molten steel is inputted into a mold of the continuous casting machine.

8. The method as claimed in claim 1, wherein at least one edge of the cast slab is chamfered by using a mold of the continuous casting machine conforming to the chamfered shape.

9. The method as claimed in claim 1, wherein at least a part of solute-enriched residual molten steel remaining in the center portion of the cast slab with a solid fraction of 0.3 to 0.6 is moved to a region of the center portion with a solid fraction of 0.2 or less.

10. The method as claimed in claim 1, wherein at least one electromagnetic stirring unit is installed between a mold of the continuous casting machine and the segment to stir the backflow molten steel in the cast slab by electromagnetic force.

* * * * *